US009013856B2

(12) United States Patent
Mahajan et al.

(10) Patent No.: US 9,013,856 B2
(45) Date of Patent: Apr. 21, 2015

(54) IGNITION EXCITER SYSTEM AND IGNITION EXCITER CIRCUIT

(75) Inventors: Deepak Mahajan, Karnataka (IN); Renukaprasad N, Karnataka (IN)

(73) Assignee: Honeywell International Inc., Morristown, NJ (US)

( * ) Notice: Subject to any disclaimer, the term of this patent is extended or adjusted under 35 U.S.C. 154(b) by 875 days.

(21) Appl. No.: 13/220,114

(22) Filed: Aug. 29, 2011

(65) Prior Publication Data

US 2013/0047577 A1 Feb. 28, 2013

(51) Int. Cl.
*F23Q 3/00* (2006.01)
*F02P 3/08* (2006.01)

(52) U.S. Cl.
CPC ..... *F02P 3/0892* (2013.01)

(58) Field of Classification Search
USPC ..... 361/256
See application file for complete search history.

(56) References Cited

U.S. PATENT DOCUMENTS 4,285,321 A 8/1981 Phelon et al.
5,456,241 A * 10/1995 Ward ..... 123/598
5,852,381 A * 12/1998 Wilmot et al. ..... 327/440
6,305,365 B1 * 10/2001 Maeoka et al. ..... 123/604
2013/0047577 A1 * 2/2013 Mahajan et al. ..... 60/39.827

FOREIGN PATENT DOCUMENTS

NZ WO2010039046 A2 4/2010

OTHER PUBLICATIONS

CircuitDB, "Capacitor Discharge Ignition Circuit (CDI)", website: http://.circuitdb.com/circuits/id/164, Jun. 4, 2011, 2 pages.

* cited by examiner

*Primary Examiner* — Ronald W Leja
(74) *Attorney, Agent, or Firm* — Ingrassia Fisher & Lorenz, P.C.

(57) ABSTRACT

An ignition circuit is provided and may include a dc-dc converter having a positive terminal and a negative terminal, an igniter plug having a first terminal and a second terminal, a first capacitor coupled to the positive terminal, a first diode coupled between the first capacitor and the negative terminal, a switching circuit coupled between the positive terminal, and the negative terminal, a second capacitor, a transformer having a primary and a secondary winding, the primary winding coupled between the negative terminal and the second capacitor and the secondary winding coupled between the negative terminal and the first terminal of igniter plug, and a second diode coupled between the first capacitor and the second terminal, wherein the second capacitor is coupled between the primary winding and the second diode, and wherein the first terminal is coupled to the secondary winding and the second terminal is connected to a ground.

18 Claims, 7 Drawing Sheets

300

IGNITION EXCITER SYSTEM AND IGNITION EXCITER CIRCUIT

TECHNICAL FIELD

The following relates to and ignition exciter system, and more particularly to an ignition exciter circuit for an engine.

BACKGROUND

Ignition exciter circuits are used to provide a spark in a combustion engine. However, typical ignition exciter systems are subject to energy loss due to one or more of charge capacitor equivalent series resistance (ESR), bleeder resistors, discharge switch leakage, diode leakage current, spark gap leakage and loss due to sensing resistors. Accordingly, improved ignition exciter circuits with reduced energy loss are desirable. Other desirable features and characteristics will become apparent from the subsequent detailed description and the appended claims, taken in conjunction with the accompanying drawings and this background.

SUMMARY

In accordance with one embodiment, an ignition circuit is provided. The ignition circuit may include, but is not limited to a dc-dc converter having a positive terminal and a negative terminal and configured to be coupled to an input voltage source and electronically controlled to output an amplified voltage across the positive terminal and the negative terminal, an igniter plug having a first terminal and a second terminal, a first capacitor coupled to the positive terminal of the dc-dc converter, a first diode coupled between the first capacitor and the negative terminal of the dc-dc converter, a switching circuit electrically coupled between the positive terminal of the dc-dc converter and the negative terminal of the dc-dc converter, a transformer having a primary and a secondary winding, the primary winding coupled between the negative terminal and the second capacitor and the secondary winding coupled between the negative terminal and the first terminal of igniter plug, a second diode electrically coupled between the first capacitor and the second terminal of the igniter plug, and a second capacitor electrically coupled between the primary winding of the transformer and the second diode, wherein the first terminal of the igniter plug is electrically coupled to the secondary winding of the transformer and second terminal of the igniter plug is connected to a ground.

In accordance with another embodiment, an ignition system exciter circuit is provided. The ignition system exciter circuit may include, but is not limited to, a storage capacitor configured to receive a charge, a discharge circuit electrically connected to the storage capacitor, an igniter plug electrically connected to the discharge circuit, and a switching circuit for controlling a discharge of the storage capacitor through the discharge circuit and igniter plug. The discharge circuit may include, but is not limited to, a saturable core step-up transformer having a primary winding and a secondary winding wherein said secondary winding includes a first terminal connected to a first terminal of the primary winding and a second terminal of the secondary winding is connected to the igniter plug, and the first terminal of the primary winding receives energy from the capacitor by operation of the switching circuit, and a resonance capacitor electrically connected to a second terminal of the said primary winding, In accordance with yet another embodiment, an engine ignition system is provided. The engine ignition system may include, but is not limited to, an amplifier configured to receive an input voltage and to selectively output an amplified voltage, a storage capacitor electrically coupled to the amplifier, a discharge circuit selectively coupled to the storage capacitor, and an igniter plug coupled to the discharge circuit. The discharge circuit may include, but is not limited to, a transformer having a primary winding and a secondary winding, and a resonant capacitor coupled to the primary winding.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

DESCRIPTION OF THE DRAWING FIGURES

Exemplary embodiments will hereinafter be described in conjunction with the following drawing figures, wherein like numerals denote like elements; and FIG. 1 is a circuit diagram of an exemplary system in igniter system in accordance with an embodiment;

DETAILED DESCRIPTION

According to various exemplary embodiments, an ignition exciter circuit and system are provided. The ignition exciter circuit may be used in any engine. In some embodiments, for example, the ignition exciter circuit may be used in a gas turbine engine for an aircraft or as part of an automobile ignition system.

Figure 1:
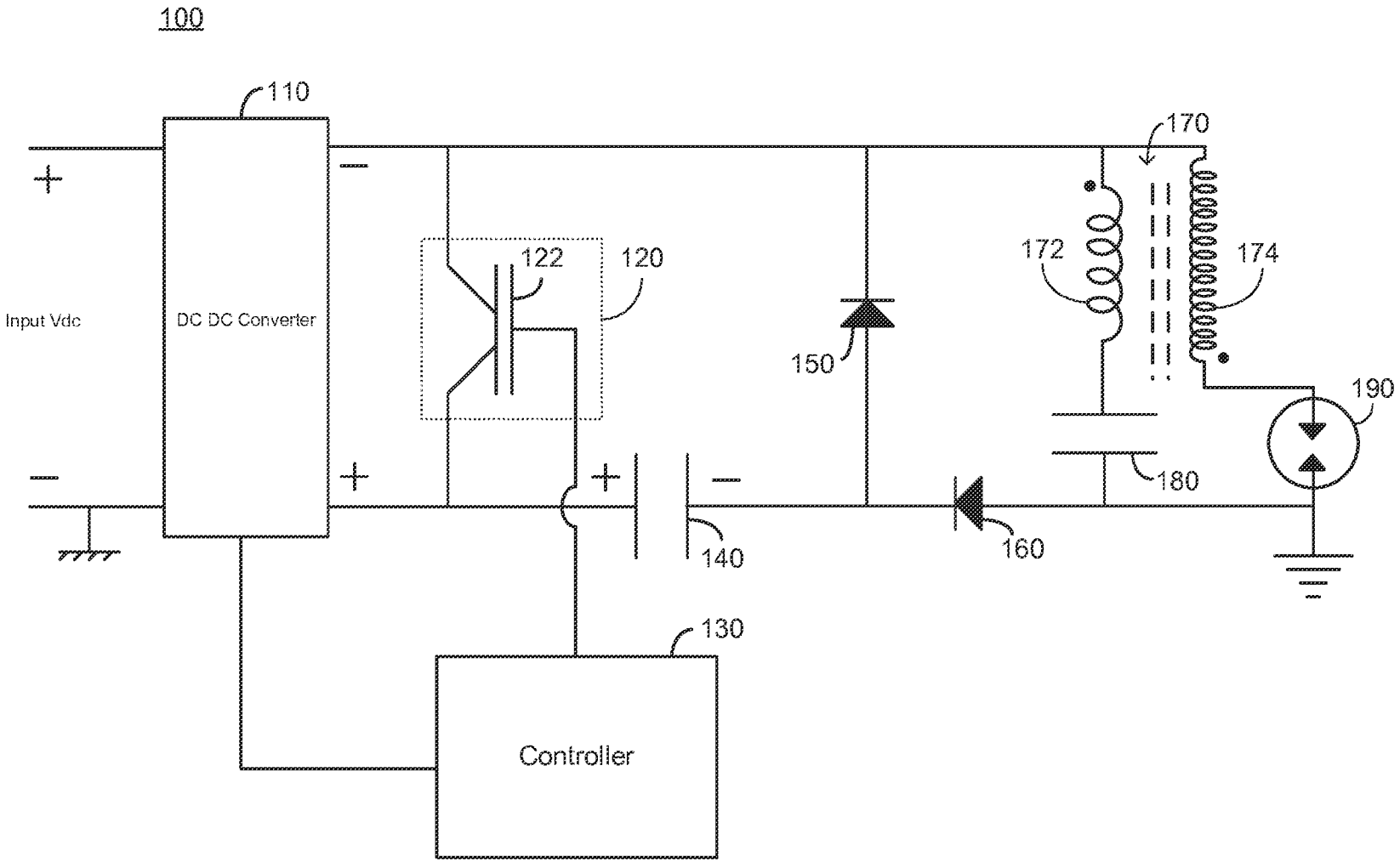

FIG. 1 is a circuit diagram of an exemplary ignition exciter circuit 100, in accordance with an embodiment. The ignition exciter circuit includes a direct current to direct current (DC-DC) converter 110 that amplifies an input DC voltage from a lower voltage to a higher voltage. In one embodiment, for example, the DC-DC converter may be electrically connected to a battery (not illustrated) which provides the input voltage. The battery may have an output voltage of approximately eighteen to thirty-two volts (V). The DC-DC converter may then amplify that input voltage. The output voltage of the DC-DC converter may vary depending upon the needs of the system. In some embodiments, for example, the DC-DC converter 110 may output a voltage anywhere from approximately one-thousand volts to thirty-five hundred volts (1 kV to 3.5 kV).

The ignition exciter circuit 100 further includes a switching circuit 120. In one embodiment, for example, switching circuit 120 may be one or more switches connected in series, parallel, or any combination thereof. In one embodiment, for example, the switching circuit 120 may be an insulated gate bipolar transistor (IGBT) 122 (hereinafter referred to as transistor 122). In other embodiment, the switching circuit 120 may be a commercial switch, such as a discharge switches or an integrated discharge switches used for pulse power applications. Typical ignition exciter circuits often utilize thyristors. However, thyristors require a complicated gate driving circuit. In contrast, a gate drive circuit required to drive the transistor 122 used in the exemplary embodiment is simpler.

A collector of the transistor 122 is electrically connected to a positive terminal output of the DC-DC converter 110, while an emitter of the transistor 122 is connected to a negative terminal output of the DC-DC converter 110. The base of the transistor 122 is electrically connected to a controller 130. In one embodiment, for example, the controller 130 may be a processor, any discrete logic, or any combination thereof. For example, the processor may be a central processing unit (CPU), a graphical processing unit (GPU), an application specific integrated device (ASIC), a field programmable gate array (FPGA), a microprocessor, or combination thereof. The controller 130 controls the transistor 122 and the DC-DC converter 110, as discussed in further detail below. In another embodiment, for example, multiple controllers may be used. For example, the ignition exciter circuit 100 may have separate controllers for the DC-DC converter 110 and the transistor 122.

In one embodiment, for example, the controller 130 may receive a command from a DEEC (Digital Electronic Engine Controller) or FADEC (Full Authority Digital Electronic Control). In response to the command, the controller 130 sends out pulses to the DC-DC converter 110 and transistor 122 to initiate a charging or discharging cycle, as discussed in further detail below.

The positive output terminal of the DC-DC converter 110 is electrically connected to a capacitor 140. The capacitor 140, which may also be referred to as storage capacitor 140, stores a charge from the DC-DC converter 110 during a charging phase, as discussed in further detail below. The size of the storage capacitor 140 may vary depending upon the spark energy requirements of the engine. In some embodiments, for example, the spark energy requirement may range from 10 milli-Joules to one Joule. However, the size of the capacitor 140 may be reduced relative to the capacitors used in prior igniter systems because the placement of diodes 150 and 160 reduce the energy lost during the charging cycle.

The diode 150 is connected between the capacitor 140 and the negative output terminal of the DC-DC converter 110. The diode 150 is oriented such that current is allowed to flow from the positive output terminal of the DC-DC converter 110 through the capacitor 140 to the negative terminal of the DC-DC converter 110, while blocking current flowing in the opposite direction.

Figure 2:
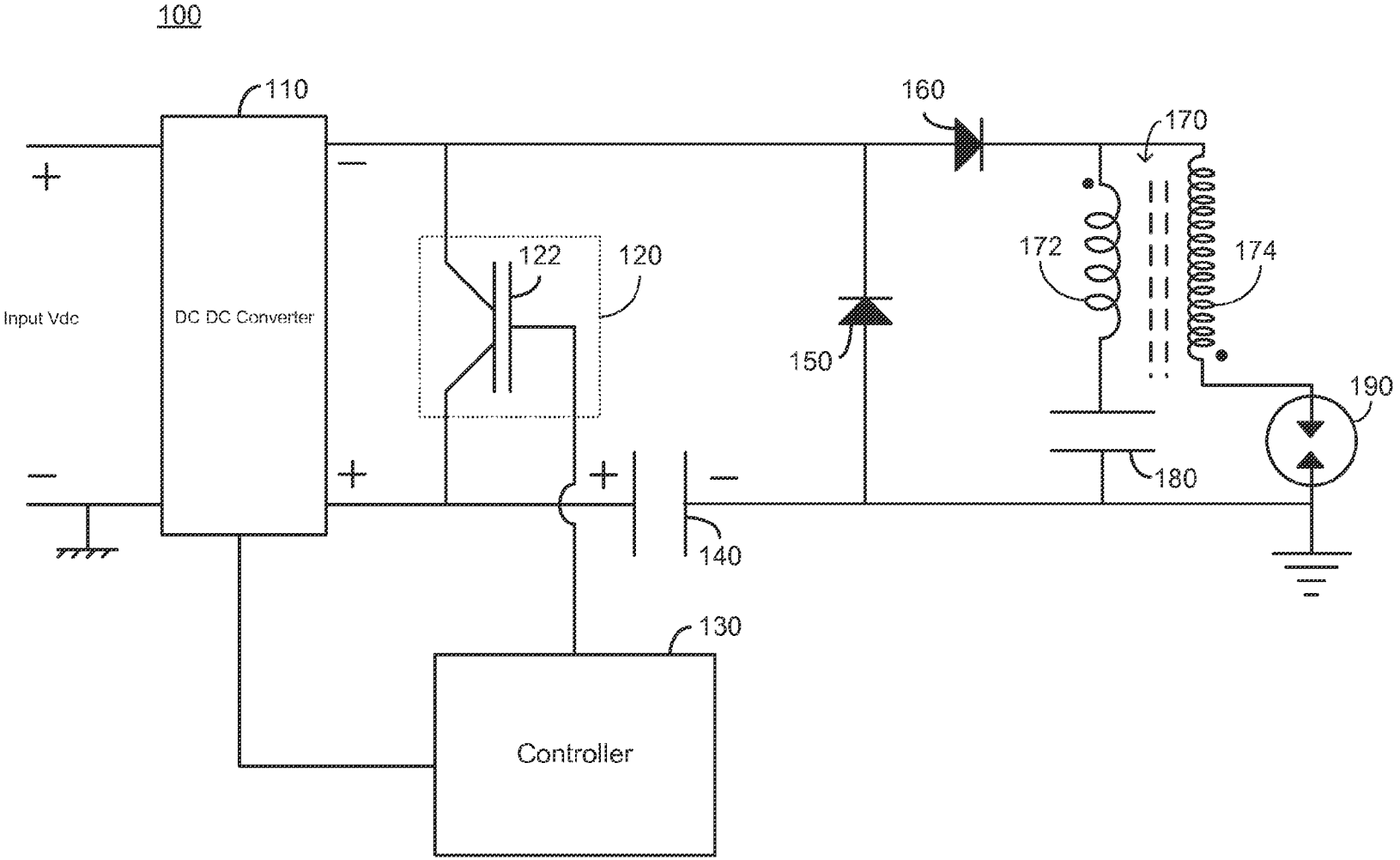
FIG. 2 is a circuit diagram of another exemplary system in igniter system in accordance with an embodiment.

The ignition exciter circuit 100 further includes a diode 160. In one embodiment, for example, the diode may be electrically connected between the capacitor 140 and a ground as illustrated in FIG. 1. In another embodiment, for example, the diode 160 may be connected between the negative output terminal of the DC-DC converter 110 and a primary winding of a transformer 170 as illustrated in FIG. 2. The diode 160, which may also be referred to as a blocking diode, is oriented in either embodiment to prevent the unnecessary energy discharge from the capacitor 140 when the capacitor 140 is being charged.

The transformer 170 may be, for example, a saturable core step-up transformer which includes a primary winding 172 and a secondary winding 174. The primary winding 172 is connected in series with a capacitor 180. The capacitor 180 and the primary winding 172 of the transformer 170 form a inductor-capacitor (LC) resonant circuit and may be referred to as a discharge circuit, as discussed in further detail below. An igniter plug 190 is connected between the capacitor 180 and the secondary winding 174 of the transformer 170. The igniter plug 190 provides a spark to an engine when a voltage across the igniter plug 190 is greater than a predetermined threshold.

Figure 3:
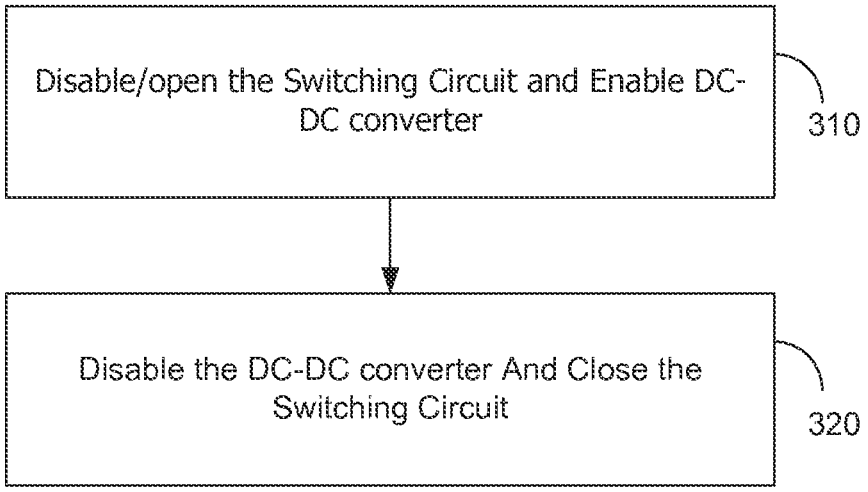
FIG. 3 is a flow chart illustrating operation of the exemplary igniter system illustrated in FIG. 1, in accordance with an embodiment.
Figure 4:
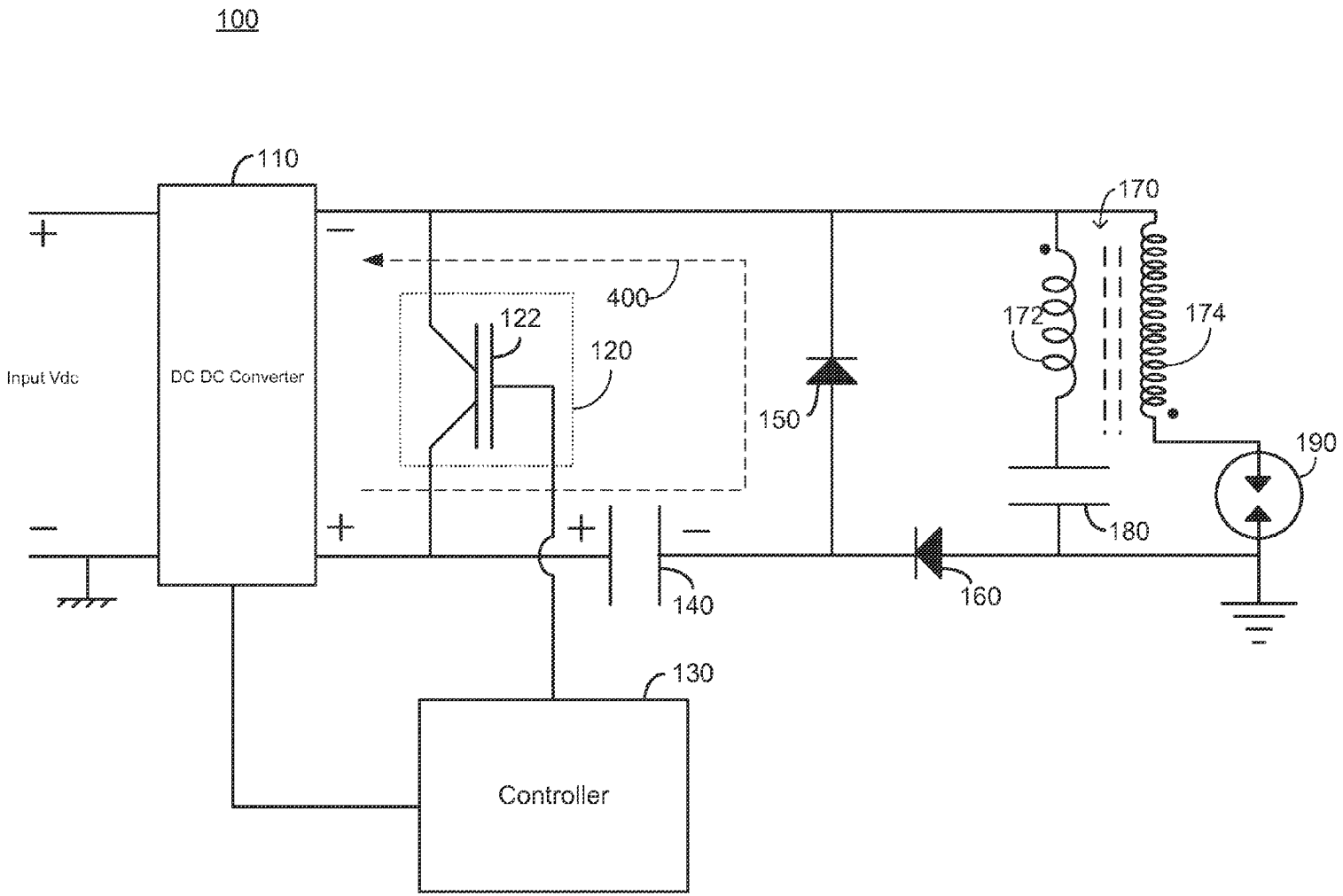
FIGS. 4-7 are circuit diagrams illustrating the operation of the exemplary igniter system illustrated in FIG. 1, in accordance with an embodiment.

FIG. 3 illustrates a method 300 of operating the ignition exciter circuit 100 illustrated in FIG. 1. The controller first disables transistor 122 and enables the DC-DC converter 110 to begin a charging phase which causes a charge to build up on the storage capacitor 140. (Step 310). During this entire charging phase, the transistor 122 remains open so there is no short between the positive and negative terminals of the DC-DC converter. FIG. 4 illustrates the flow of current in the charging phase. In this phase current flows from the positive terminal of the DC-DC converter 110 through the storage capacitor 140, through the diode 150 to the negative terminal of the DC-DC converter 110 as illustrated by arrow 400. The open state of the transistor 122 in addition to the orientation of the diodes 150 and 160 ensure that there is no electrical conductivity between the storage capacitors 140 and a positive terminal of the igniter plug 190 during the charging cycle. This ensures that the energy stored in the charging capacitor 140 is not lost during the charging cycle even if the igniter plug 190 becomes leaky over time. During the charging phase, the storage capacitor 140 is charged to a predetermined voltage, based upon the voltage output of the DC-DC converter. In one embodiment, for example, the storage capacitor 140 may be charged until the capacitor 140 has a voltage between one-thousand volts to thirty-five hundred volts (1 kV to 3.5 kV).

Figure 5:
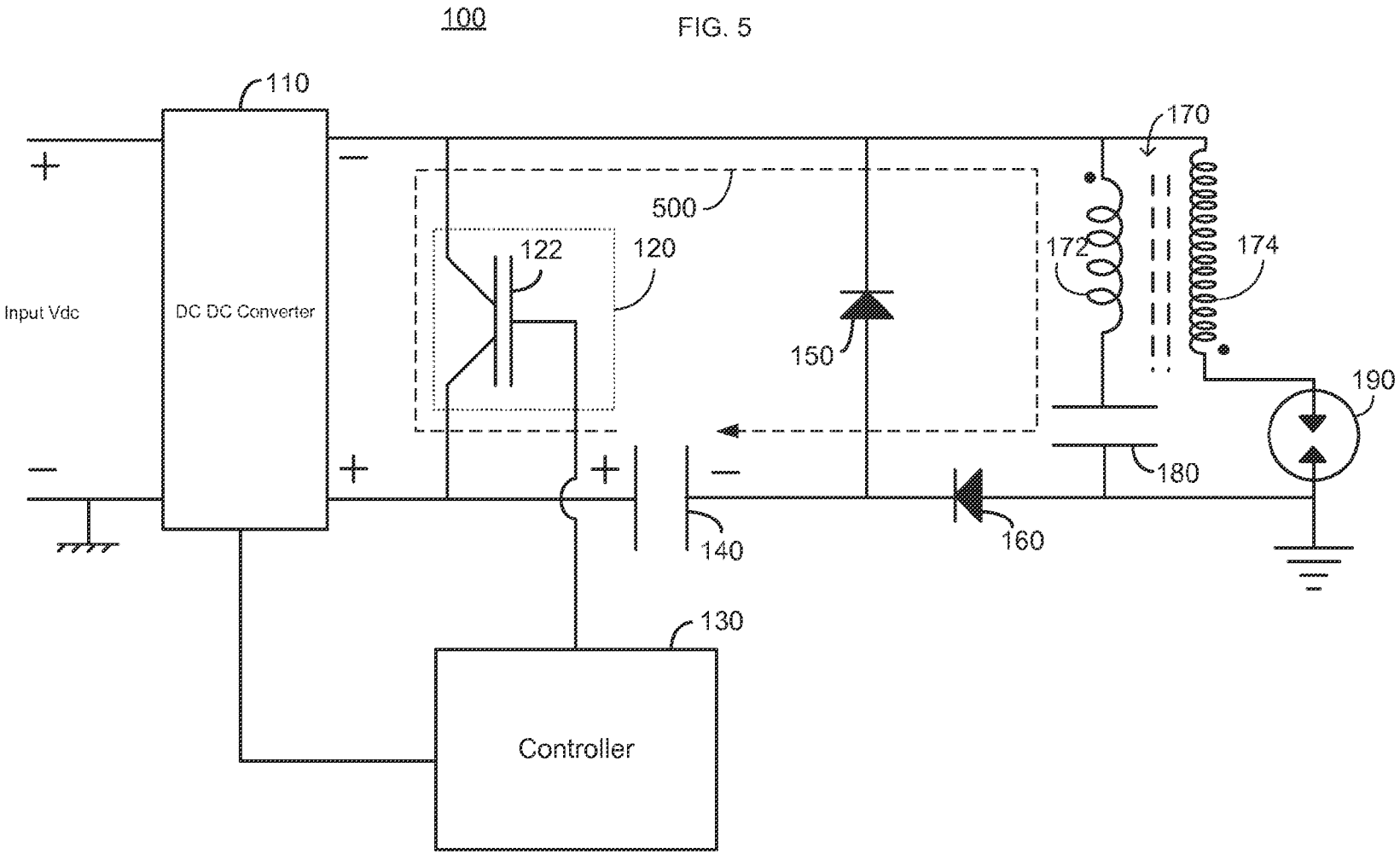

After the storage capacitor 140 has been charged, the controller 130 disables the DC-DC converter 110 and closes the transistor 122. (Step 320). The capacitor 140 then begins to discharge. FIG. 5 illustrates a current flow during an initial phase of the capacitor 140 discharging phase. While the capacitor is discharging, a current flows from a positive terminal of the capacitor, through the collector and emitter of the transistor 122, through the primary winding 172 of the transformer 170 and the capacitor 180, as illustrated by arrow 500 in FIG. 5. The current, illustrated by arrow 500 in FIG. 5 causes a resonance to be initiated between the primary winding 172 of the transformer 170 and resonant capacitor 180.

The resonance voltage in primary winding 172 of the transformer 170 gets reflected onto the secondary winding 174 of the transformer 170 and is amplified based upon the turns-ratio of the transformer 170. The voltage applied at the positive terminal of the igniter plug is the sum of voltage across the storage capacitor 140 and the voltage across the secondary winding 174 of the transformer 170. The voltage at the igniter plug ionizes the air at the spark gap of the igniter plug. The inductance of the secondary winding 174 of the transformer 170 limits the rate of rise of current into the igniter plug in the beginning of discharge cycle.

Figure 6:
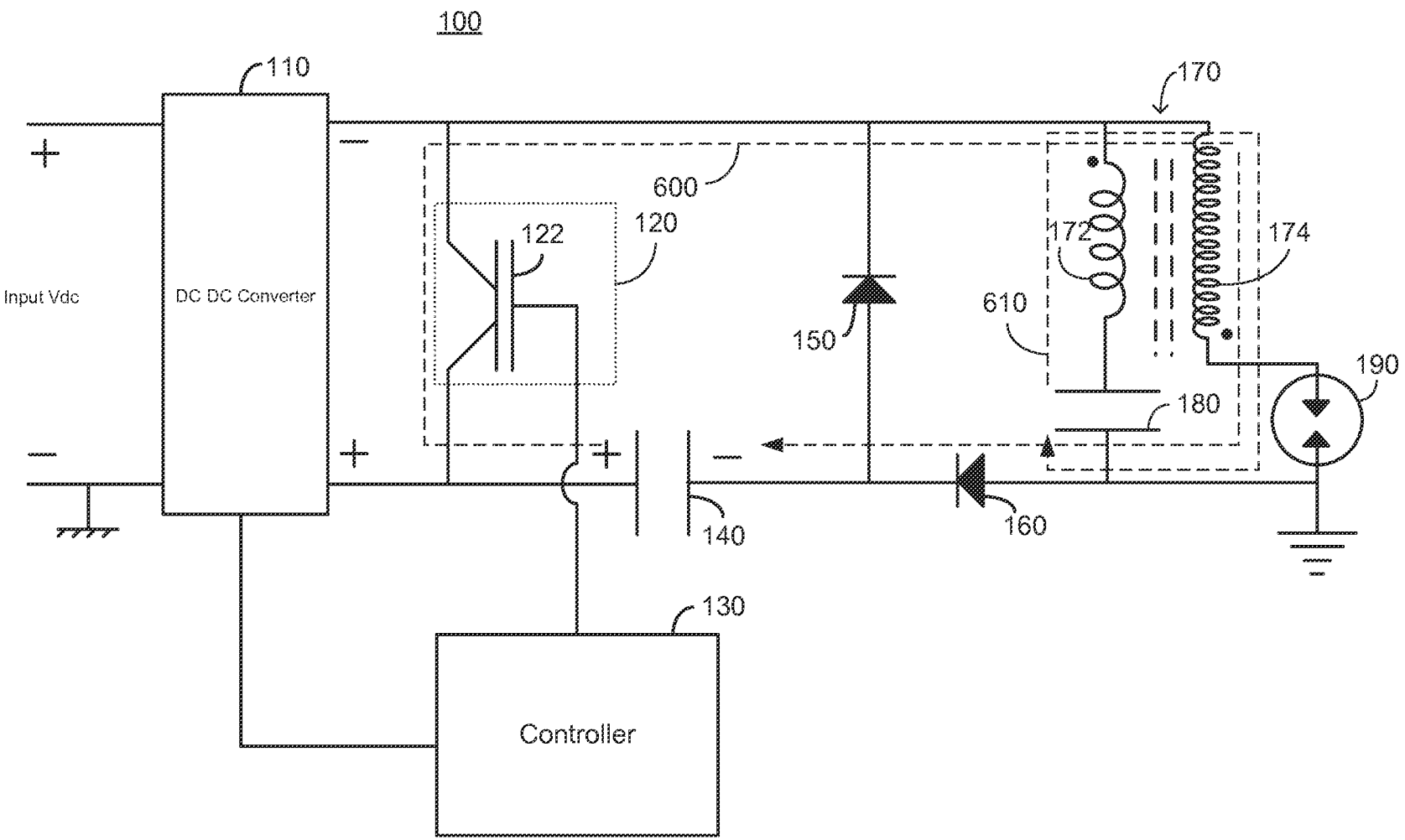

FIG. 6 illustrates a current flow during a secondary phase of the capacitor 140 discharging phase. As the current in the secondary winding 174 of transformer 170 increases, the magnetic core of the transformer 170 saturates and the rate of rise of current into the igniter plug 190 increases rapidly. The storage capacitor 140 discharges into the igniter plug 190 through transistor 122 and the secondary winding 174 of transformer 170, as illustrated by arrow 600 in FIG. 6. The resonant capacitor 180 also discharges into igniter plug 190 contributing to the peak energy delivery to the spark. The resonant capacitor discharge path is illustrated by arrow 610 in FIG. 6.

Figure 7:
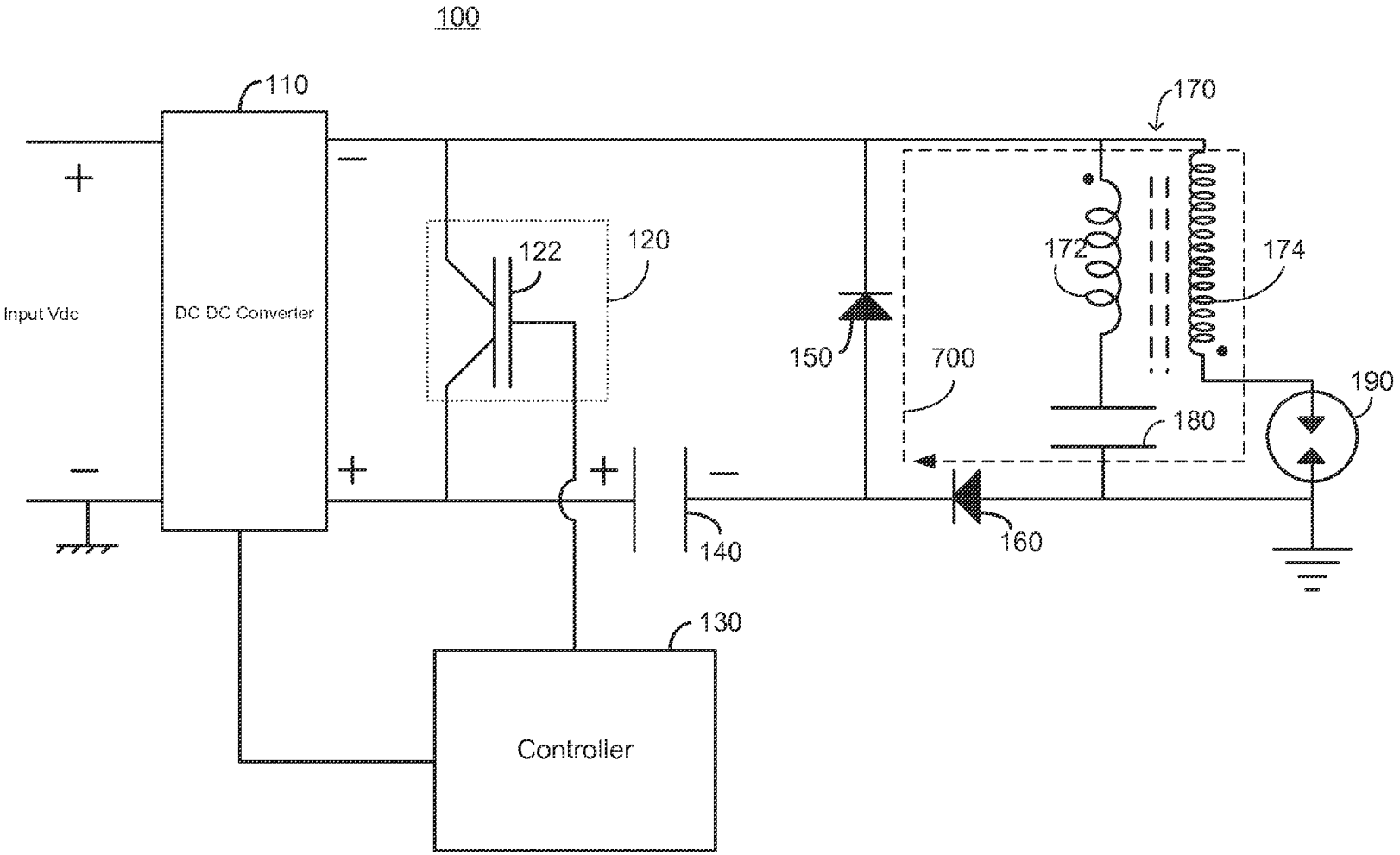

FIG. 7 illustrates a current flow after the storage capacitor 140 is completely discharged. After the storage capacitor 140 is discharged, the current through transistor 122 drops down to zero, while current through the igniter plug 190 continues and freewheels through the diodes 150 and 160 until the energy stored in the discharge circuit (the LC circuit formed by the primary winding 172 and the resonant capacitor 180) is completely discharged into the igniter plug as illustrated by arrow 700 in FIG. 7.

Generally speaking, the various functions and features of method 300 may be carried out with any sort of hardware, software and/or firmware logic that is stored and/or executed on any platform. Some or all of method 300 may be carried out, for example, by the controller 130 illustrated in FIG. 1. For example, various functions shown in FIG. 3 may be implemented using software or firmware logic. The particular hardware, software and/or firmware logic that implements any of the various functions shown in FIG. 3, however, may vary from context to context, implementation to implementation, and embodiment to embodiment in accordance with the various features, structures and environments set forth herein. The particular means used to implement each of the various functions shown in FIG. 3, then, could be any sort of processing structures that are capable of executing software and/or firmware logic in any format, and/or any sort of application-specific or general purpose hardware, including any sort of discrete and/or integrated circuitry.

The term "exemplary" is used herein to represent one example, instance or illustration that may have any number of alternates. Any implementation described herein as "exemplary" should not necessarily be construed as preferred or advantageous over other implementations.

Although several exemplary embodiments have been presented in the foregoing description, it should be appreciated that a vast number of alternate but equivalent variations exist, and the examples presented herein are not intended to limit the scope, applicability, or configuration of the invention in any way. To the contrary, various changes may be made in the function and arrangement of the various features described herein without departing from the scope of the claims and their legal equivalents.

What is claimed is:

1. An ignition circuit, comprising:

a dc-dc converter having a positive terminal and a negative terminal and configured to be coupled to an input voltage source and electronically controlled to output an amplified voltage across the positive terminal and the negative terminal;

an igniter plug having a first terminal and a second terminal;

a first capacitor coupled to the positive terminal of the dc-dc converter;

a first diode coupled between the first capacitor and the negative terminal of the dc-dc converter;

a switching circuit electrically coupled between the positive terminal of the dc-dc converter and the negative terminal of the dc-dc converter;

a second capacitor;

a transformer having a primary and a secondary winding, the primary winding electrically coupled between the negative terminal of the dc-dc converter and the second capacitor and the secondary winding electrically coupled between the negative terminal of the dc-dc converter and the first terminal of igniter plug; and a second diode electrically coupled between the first capacitor and the second terminal of the igniter plug, wherein the second capacitor is electrically coupled between the primary winding of the transformer and the second diode, and wherein the first terminal of the igniter plug is electrically coupled to the secondary winding of the transformer and the second terminal of the igniter plug is connected to a ground.

2. The ignition circuit of claim 1, wherein the second diode is electrically coupled between the first diode and the primary winding of the transformer.

3. The ignition circuit of claim 1, wherein the second diode is electrically coupled between the first capacitor and the second capacitor.

4. The ignition circuit of claim 1, further comprising a controller electrically coupled to the dc-dc converter and the switching circuit, wherein the controller is configured to:

open the switching circuit; and enable the dc-dc converter to charge the first capacitor.

5. The ignition circuit of claim 4, wherein after the first capacitor is charged to a predetermined voltage, the controller is further configured to:

disable the dc-dc converter; and close the switching circuit.

6. The ignition circuit of claim 1, wherein the transformer is a saturable core step-up transformer.

7. The ignition circuit of claim 1, wherein the switching circuit is a single insulated-gate bipolar transistor.

8. The ignition circuit of claim 1, wherein the switching circuit is an integrated discharge switch.

9. The ignition circuit of claim 1, wherein the switching circuit comprises a plurality of integrated discharge switches.

10. The ignition circuit of claim 1, wherein the switching circuit comprises a plurality of insulated-gate bipolar transistors.

11. The ignition circuit of claim 1, wherein the primary winding of the transformer and the second capacitor are configured to form a inductor-capacitor series resonant circuit.

12. An ignition system exciter circuit, comprising:

a storage capacitor configured to receive a charge;

a discharge circuit electrically connected to the storage capacitor;

an igniter plug electrically connected to the discharge circuit;

a switching circuit for controlling a discharge of the storage capacitor through the discharge circuit and igniter plug; and a first diode configured to provide a high impedance path when the storage capacitor is being charged to block energy loss through the said discharge circuit and the igniter plug, said discharge circuit comprising:

a saturable core step-up transformer having a primary winding and a secondary winding wherein said secondary winding includes a first terminal connected to a first terminal of the primary winding and a second terminal of the secondary winding is connected to the igniter plug, and the first terminal of the primary winding receives energy from the storage capacitor by operation of the switching circuit; and a resonance capacitor electrically connected to a second terminal of the said primary winding.

13. The ignition system exciter circuit of claim 12, further comprising a dc-dc converter to selectively charge the storage capacitor.

14. The ignition system exciter circuit of claim 12, wherein the first diode is further configured to provide a low impedance path when the storage capacitor is being discharged.

15. The ignition system exciter circuit of claim 14, further comprising a second diode, where in the first diode and second diode are configured to provide a freewheeling energy path to the igniter plug while energy is stored in the primary winding of the transformer.

16. The ignition system exciter circuit of claim 12, wherein said switching circuit comprises a switch that provides a very low impedance path from the storage capacitor to the igniter plug when the storage capacitor is being discharged.

17. The ignition system exciter circuit of claim 12, wherein the ignition system is used in a gas turbine engine.

18. An engine ignition system, comprising:

an amplifier configured to receive an input voltage and to selectively output an amplified voltage;

a storage capacitor electrically coupled to the amplifier;

a discharge circuit selectively coupled to the storage capacitor;

an igniter plug coupled to the discharge circuit; and a diode configured to provide a high impedance path when the storage capacitor is being charged to block energy loss through the said discharge circuit and the igniter plug, wherein the discharge circuit further comprises:

a transformer having a primary winding and a secondary winding; and a resonant capacitor coupled to the primary winding.

* * * * *